US007210531B2

(12) United States Patent
van Belkom et al.

(10) Patent No.: US 7,210,531 B2
(45) Date of Patent: May 1, 2007

(54) PROTECTIVE ELEMENT FOR A RISER SEGMENT

(75) Inventors: Arnoldus van Belkom, Spannum (NL); Martin Esselbrugge, Sneek (NL)

(73) Assignee: Lankhorst Recycling B.V., Sneek (NL)

( * ) Notice: Subject to any disclaimer, the term of this patent is extended or adjusted under 35 U.S.C. 154(b) by 126 days.

(21) Appl. No.: 10/416,155

(22) PCT Filed: Nov. 13, 2001

(86) PCT No.: PCT/NL01/00819

§ 371 (c)(1),
(2), (4) Date: Oct. 30, 2003

(87) PCT Pub. No.: WO02/40821

PCT Pub. Date: May 23, 2002

(65) Prior Publication Data

US 2004/0062612 A1 Apr. 1, 2004

(30) Foreign Application Priority Data

Nov. 15, 2000 (NL) ..... 1016610

(51) Int. Cl.
*E21B 29/12* (2006.01)

(52) U.S. Cl. ..... 166/367; 166/359; 166/356; 405/224.4

(58) Field of Classification Search ..... 166/368, 166/367, 350, 356, 359; 405/224.2, 224, 405/224.4

See application file for complete search history.

(56) References Cited

U.S. PATENT DOCUMENTS

| | | | | | |
|---|---|---|---|---|---|
| 4,126,183 | A | | 11/1978 | Walker | 166/338 |
| 4,210,208 | A | | 7/1980 | Shanks | 166/352 |
| 4,422,801 | A | * | 12/1983 | Hale et al. | 405/171 |
| 4,470,722 | A | * | 9/1984 | Gregory | 405/224.2 |
| 4,474,129 | A | * | 10/1984 | Watkins et al. | 114/243 |
| 4,477,207 | A | * | 10/1984 | Johnson | 405/195.1 |
| 4,527,928 | A | | 7/1985 | Rutherford et al. | 405/211 |
| 4,596,531 | A | * | 6/1986 | Schawann et al. | 441/133 |
| 4,634,314 | A | * | 1/1987 | Pierce | 405/224.2 |
| 4,646,840 | A | * | 3/1987 | Bartholomew et al. | 166/350 |
| 5,330,294 | A | * | 7/1994 | Guesnon | 405/224.2 |
| 5,380,131 | A | * | 1/1995 | Crawford | 405/216 |
| 5,758,990 | A | * | 6/1998 | Davies et al. | 405/224.4 |
| 5,918,675 | A | | 7/1999 | Borak, Jr. et al. | 166/349 |
| 6,155,748 | A | * | 12/2000 | Allen et al. | 405/195.1 |
| 6,406,223 | B1 | * | 6/2002 | Thomas | 405/224.2 |
| 6,435,775 | B1 | * | 8/2002 | Nish et al. | 405/224.2 |
| 6,805,201 | B2 | * | 10/2004 | Nish et al. | 166/367 |

FOREIGN PATENT DOCUMENTS

NL 7404724 4/1974

* cited by examiner

*Primary Examiner*—Thomas A Beach
(74) *Attorney, Agent, or Firm*—Jacobson Holman PLLC

(57) ABSTRACT

A protective element for a riser segment, including an elongated buffer body, at least one foot connected with the buffer body, the at least one foot being provided with an engagement part arranged to engage on a main pipe of a riser segment, the distance between the engagement part of the foot and the buffer body being such that in a mounted condition the part of the buffer body located farthest from the main pipe is located farther from the main pipe than auxiliary pipe elements arranged on the main pipe.

12 Claims, 5 Drawing Sheets

PROTECTIVE ELEMENT FOR A RISER SEGMENT

This is a nationalization of PCT/NL01/00819 filed Nov. 13, 2001 and published in English.

FIELD OF THE INVENTION

Background of the Invention

This invention relates to a protective element for a riser segment, and to a riser part provided with protective elements.

In offshore exploitation and preparation for exploitation of submarine wells of natural resources in places where the sea bottom lies relatively deep below the water surface, use is made of an offshore construction breaking through the water surface. To be able to reach a well, the floating offshore construction, often a drilling ship or a semi-submersible, is positioned on the water surface above the well. Next, from the buoyant offshore construction, a riser is lowered which is coupled to a stop valve already provided on the sea bottom. The riser forms a guarded conduit through which, for instance, during the preparation of well exploitation, drilling tools can be lowered and, during exploitation, natural resources can be conveyed from the well to the offshore construction without these resources coming into contact with water.

The riser structure is typically built up from riser segments which are coupled during lowering and detached again during raising. Usually, a riser segment comprises a main pipe which is surrounded by a number of auxiliary pipes. In general, the diameter of the main pipe is greater than the diameters of the auxiliary pipes. The auxiliary pipes are positioned uniformly around the main pipe and fixed on the main pipe through collars.

The riser structure is somewhat flexible, and under water is held in a bent condition, such as, for instance, in a so-called lazy or steep wave configuration. To that end, some segments of the riser are provided with floats. Bare risers is the term used for riser parts without buoyancy.

The riser segments are built up ashore by fitting the auxiliary pipes on the main pipe through collars. Next, the riser segments are conveyed upright to the offshore exploration site.

A drawback involved here is that the riser segments are vulnerable due to the projecting auxiliary pipes. Consequently, the risk of damage during transport and storage is high.

SUMMARY OF THE INVENTION

The object of the invention is to provide a device with which riser segments are properly protected, so that the segments are at lesser risk of sustaining damage during transport and storage.

To that end, the invention provides a protective element. In the mounted condition, the respective buffer bodies of the protective elements are situated farther from the main pipe than are the auxiliary pipes; consequently, the buffer bodies protect the vulnerable auxiliary pipes from, for instance, shocks. The transport and storage of riser segments on which the protective elements according to the invention have been mounted is thereby considerably simplified.

By designing the protective elements with supporting parts, the riser segments can be laid down and stacked, which further facilitates storage of the riser segments.

BRIEF DESCRIPTION OF THE DRAWINGS

Further aspects, effects, advantages and details of the invention are elucidated below on the basis of an exemplary embodiment of the invention, with reference to the drawing. In the drawings.

DETAILED DESCRIPTION OF THE PREFERRED EMBODIMENTS

Figure 1A:
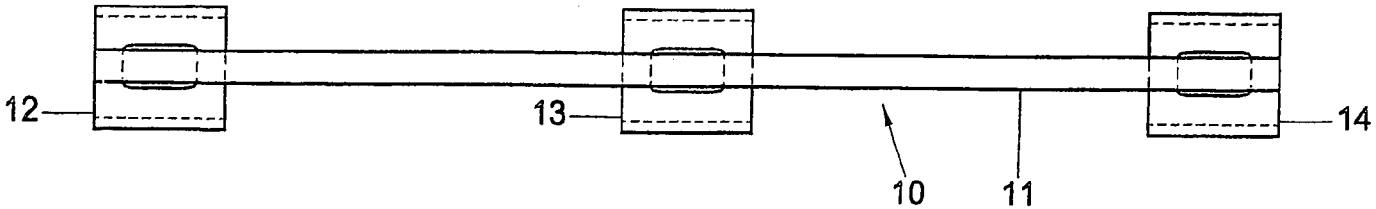
FIGS. 1A–D show a top, side and front view, as well as a perspective view of a first protective element.
Figure 1B:
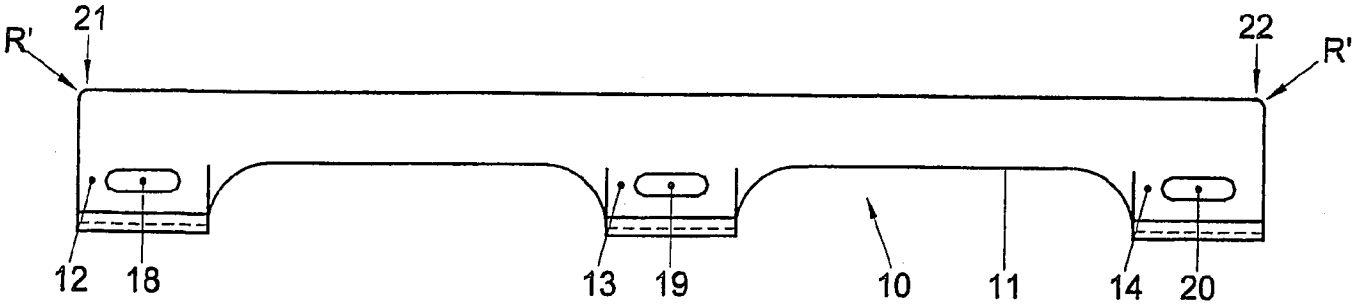
Figure 1C:
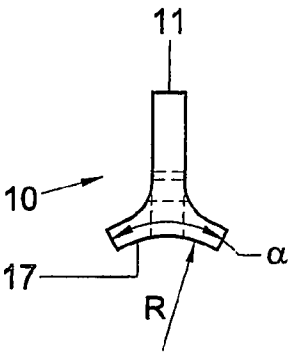
Figure 1D:
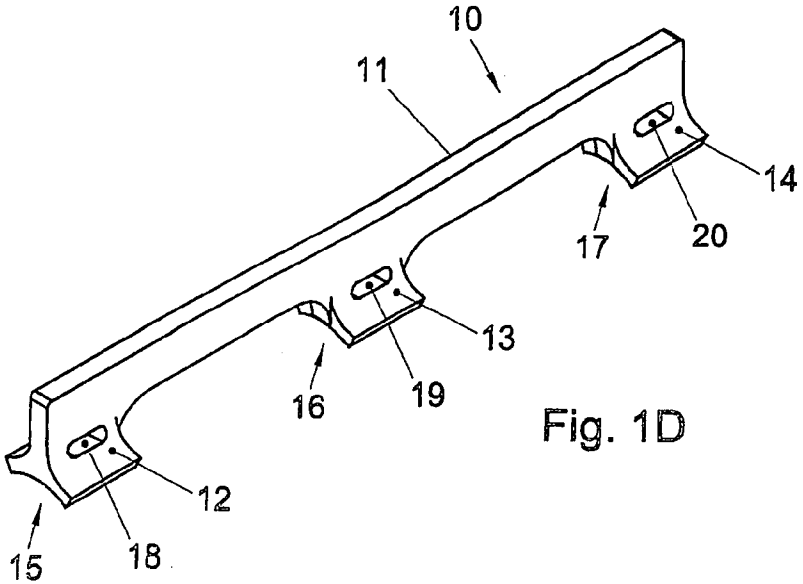
Figure 2A:
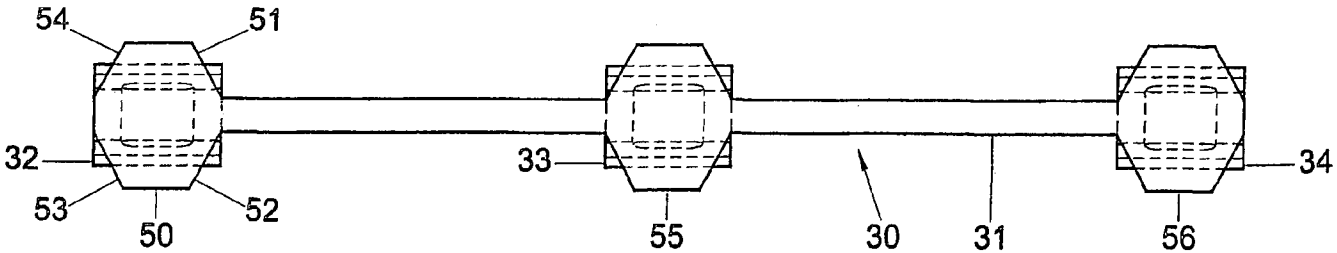
FIGS. 2A–D show a top, side and front view, as well as a perspective view of a second protective element.
Figure 2B:
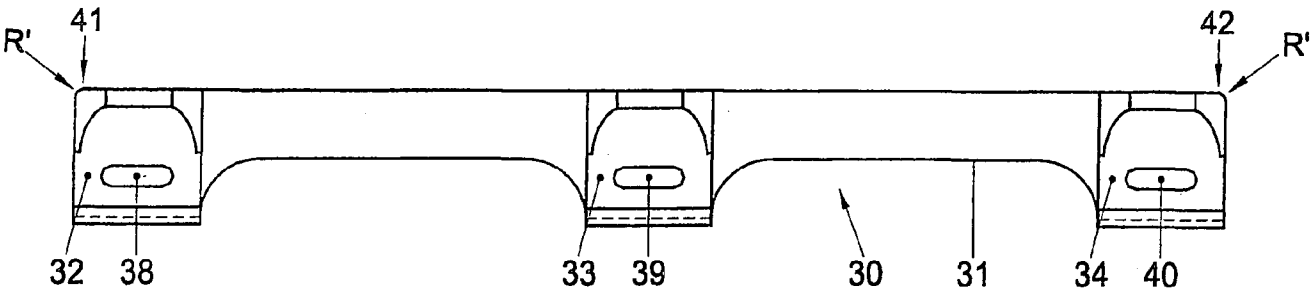
Figure 2C:
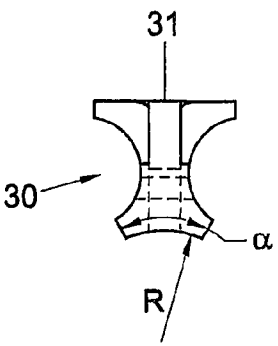
Figure 2D:
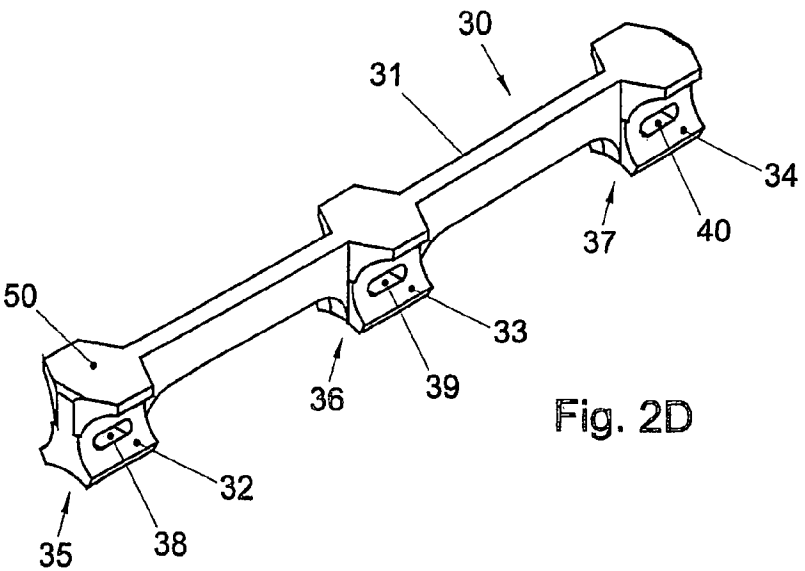

In FIG. 1 an example of a protective element according to the invention is shown. The element 10 has an elongated buffer body 11, which, in this example, is designed as a beam having a rectangular cross section. The buffer body 11 in this example has three feet 12, 13, and 14, with feet 12 and 14 arranged at the ends of the buffer body 11 and foot 13 arranged in the middle of the buffer body 11. The feet 12, 13, 14 have respective engagement parts 15, 16, and 17 which, in this example, are designed as a concave part which includes an angle $\alpha$ and has a radius R. Further, the feet 12, 13, 14 are provided with coupling means in the form of the respective recesses 18, 19, and 20. The recesses 18, 19, 20 are elongated in shape, such that they can receive tensioning means, such as, for instance, a strap. The corners 21 and 22 located at the top at the ends of the buffer body 11 have been rounded off with a radius R'.

In FIG. 2 an example of a second protective element according to the invention is shown. The element 30 has an elongated buffer body 31 which, in this example, is designed as a beam having a rectangular cross section. The buffer body 31 in this example has three feet 32, 33, and 34, with feet 32 and 34 arranged at the ends of the buffer body 31 and foot 33 arranged in the middle of the buffer body 31. The feet 32, 33, 34 have respective engagement parts 35, 36, and 37 which, in this example, are designed as a concave part which includes an angle $\alpha$ and has a radius R. Further, the feet 32, 33, 34 are provided with coupling means in the form of the respective recesses 38, 39 and 40. The recesses 38, 39, 40 are elongated in shape, such that they can receive tensioning means, such as, for instance, a strap. The corners 41 and 42 located at the top at the ends of the buffer body 31 have been rounded off with a radius R'.

At the top, the buffer body 31 is provided with three supporting parts 50, 55, 56. The supporting part 50, in top plan view, is substantially hexagonal in shape, with bevels 51–54 including an angle with the longitudinal direction of the buffer body.

Figure 3:
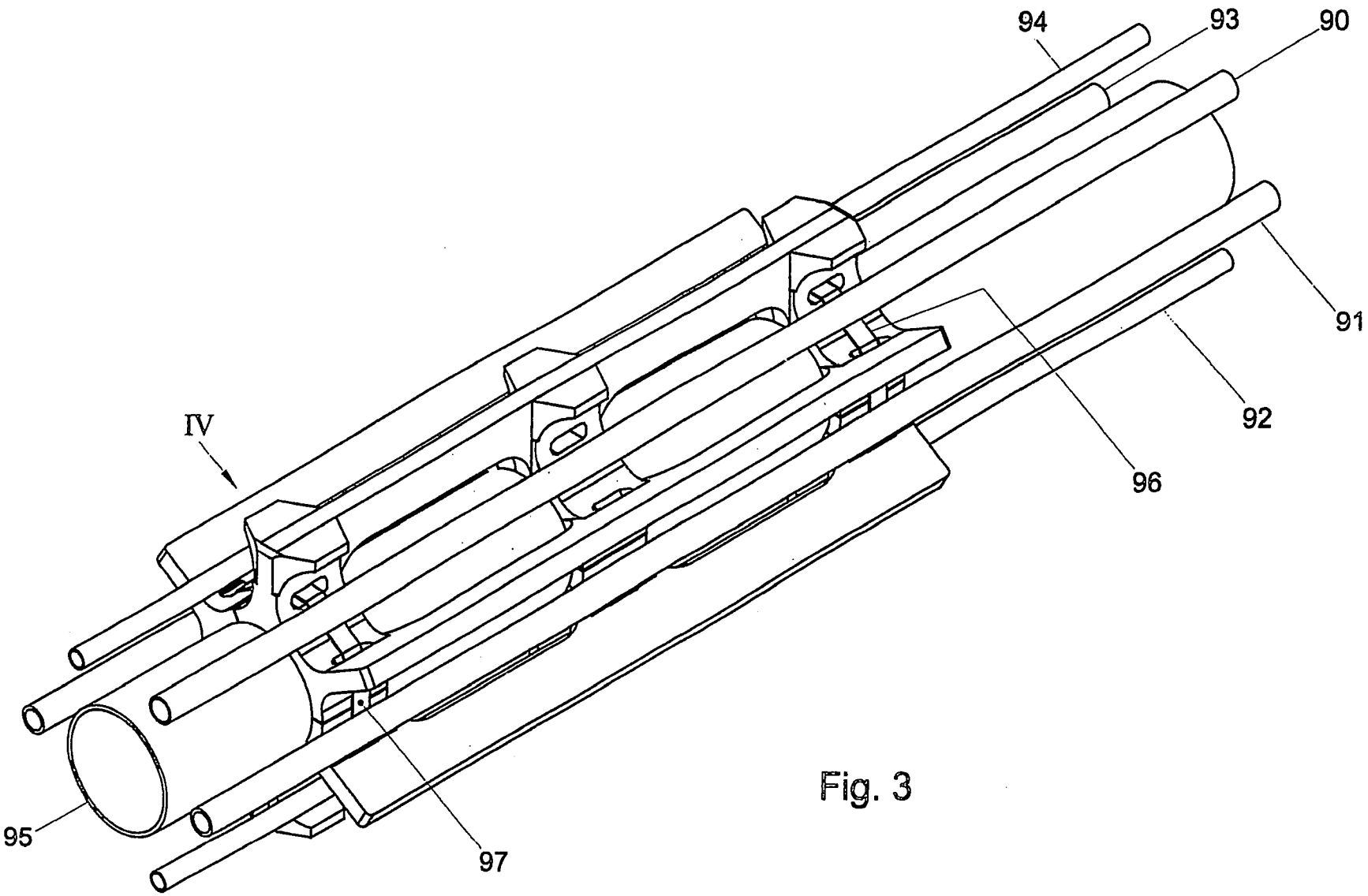
FIG. 3 shows a perspective view of a part of a riser segment provided with protective elements according to the invention.
Figure 4:
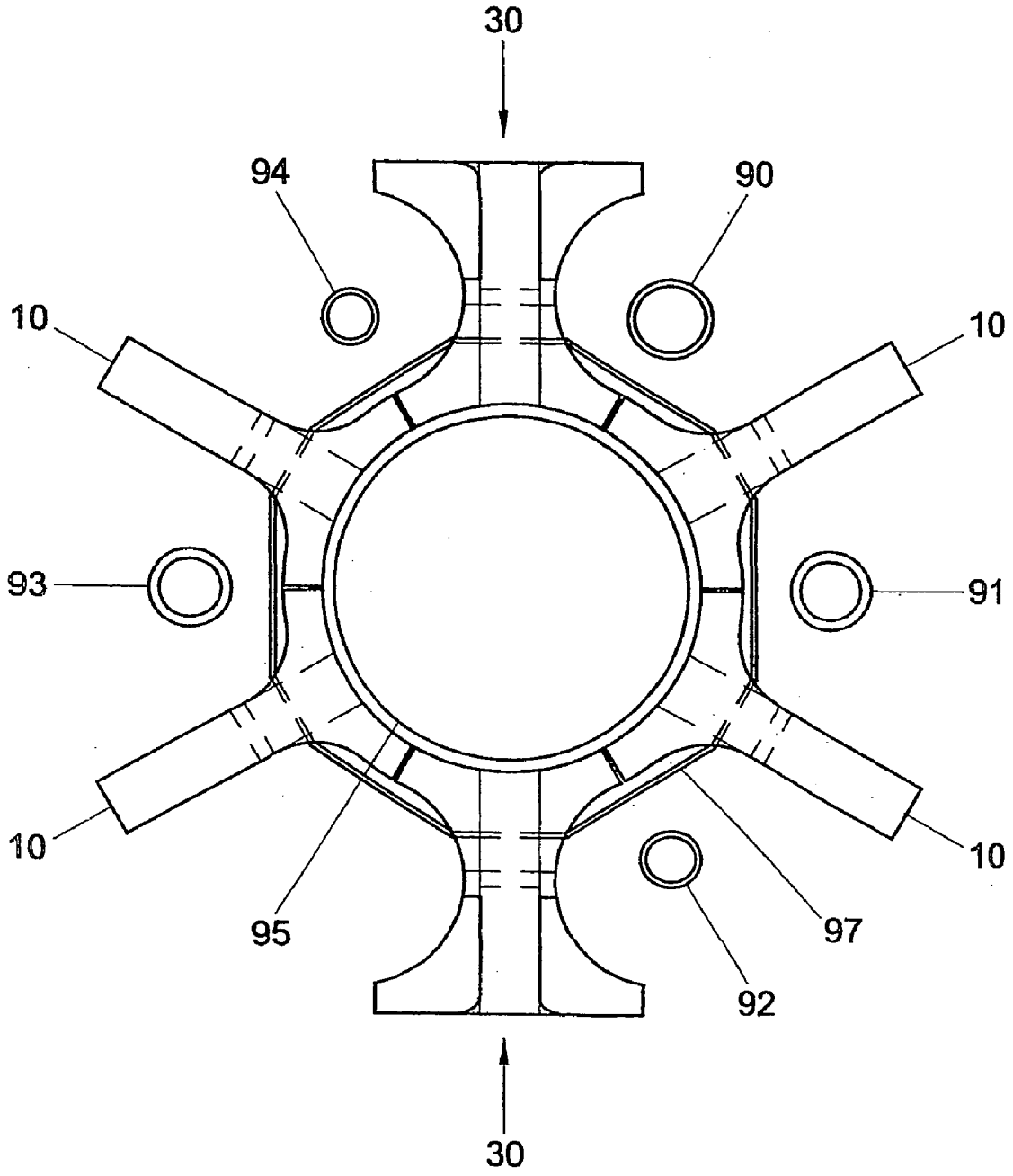
FIG. 4 shows a cross section of the riser segment from FIG. 3 adjacent the point IV.

FIGS. 3 and 4 shows a riser segment provided with protective elements according to the invention. The riser comprises a central main pipe 95 on which, in this example, five auxiliary pipes 90–94 have been arranged in a manner known per se, by means of collars, not shown. Between the auxiliary pipes, six protective elements 10 and 30 as described above have been arranged and fixed by means of straps which pass through the respective recesses of the feet. Two straps 96 and 97 are shown in FIG. 3. The straps pass through the respective openings in the feet. The respective feet by way of their concave parts engage the outer jacket of the main pipe. In this example, the angle α included by the concave parts is less than 60°, for instance 58°, so that all feet engage the main pipe, and also in the event of any expansion due to, for instance, thermal influences, the feet remain in engagement.

In the mounted condition, the respective buffer bodies of the protective elements are situated farther from the main pipe than the auxiliary pipes; consequently, the buffer bodies protect the vulnerable auxiliary pipes from, for instance, shocks. The riser part formed by the riser segment provided with protective elements can be transported without risk of damages.

As the buffer bodies are made of relatively slender design, the flow resistance of a riser provided with the protective elements according to the invention is relatively low.

The cross section of the buffer body is such that, in combination with the material properties, the bending stiffness of the buffer body between two adjacent feet is less than the bending stiffness of the main pipe of the riser segment. As a result, the protective elements do not hamper the bending of the riser segments desired in use. To obtain the desired bending stiffness, the number and the position of the feet can be adjusted.

In this example, two protective elements 30 are arranged on the main pipe, which, as shown in FIG. 4, are located diametrically opposite each other. By virtue of the supporting parts 50, 55, 56, the riser segment can be stably arranged on the ground, and riser segments can be stacked. This simplifies storage of riser segments considerably. If desired, one, several or all protective elements for each riser can be equipped with supporting parts. If desired, only protective elements of the type without supporting parts can be used.

In the longitudinal direction of the riser, projecting sections of the protective elements have been rounded, such as, for instance, the corners 21, 22, 41, 42, or beveled, such as, for instance, the supporting parts 50, 55, 56 by means of the bevel sides 51-54, so that during use, and in particular during transport, assembly and disassembly, the risk of the riser being caught on anything is low.

In FIG. 3, by way of example, a part of a riser part is shown; in practice, the pipe sections can be longer, and several protective elements can be arranged behind each other in the longitudinal direction of the pipe. Preferably, such elements placed behind each other link up with each other directly with a minor interspace to reduce the risk of hooking during use.

The protective elements are clamped onto the main pipe by means of straps. The straps have been passed through the respective openings in the feet and secured. Although in this example the protective elements have been fitted onto the main pipe through straps, other fastening means can be used.

Figure 5:
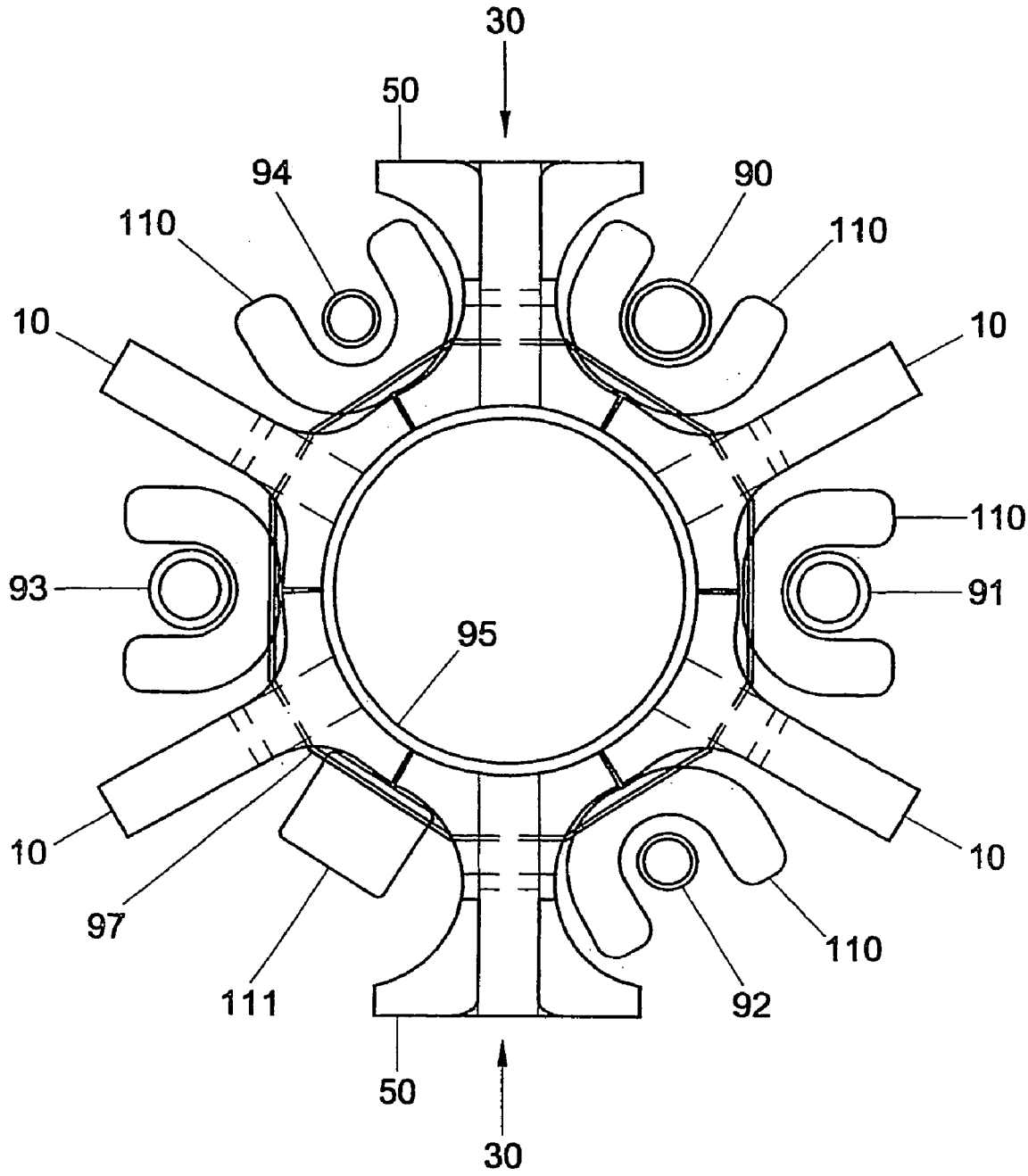
FIG. 5 shows a cross section of another riser segment according to the invention.

In FIG. 5 a variant embodiment according to the invention is shown, in which the riser segment is provided with floats. The parts corresponding to the exemplary embodiment discussed above are designated in FIG. 5 with the same numerals, and for the sake of brevity, for a description thereof, reference is made to the foregoing. In the example shown, the floats are formed by profiles 110 substantially U-shaped in cross section, of a material having a low density. Such materials are known from practice. The floats 110 are connected with the riser segment. In this example, the floats 110 are provided with a passage in the lower part of the U-shape and the floats are connected to the riser by means of the above-described straps. The shape of the profiles in this example has been chosen such that the legs of the U in mounted condition project above the auxiliary pipes and thus afford additional protection. Preferably, the floats are so positioned with respect to the protective elements and the main pipe, that the floats do not project-above the protective elements. Advantageously, the protective elements in this manner protect the floats from impacts. Consequently, a hard and impact-resistant outer jacket for the floats is no longer needed, so that they can be made of simpler and cheaper design.

It is noted that the floats can have any desired shape, such as, for instance, a profile having a rectangular cross section, such as float 111 as shown in FIG. 5. This float 111 is likewise connected with the riser through the strap.

Although in this example six protective elements are shown around the circumference of the main pipe, the invention can also be used with different numbers of protective elements. Preferably, the concave engaging part of the feet of the protective elements is such that in mounted condition the concave parts surround substantially the entire circumference of the pipe, so that the protective elements are properly fixed with respect to the pipe.

Preferably, the protective elements according to the invention are manufactured from plastic and in particular polyolefins, such as, for instance PP and PE. Particularly advantageously, the elements can be manufactured from recycled plastic, so that the material costs can be reduced without compromising the quality and so that the elements can be reused without problems.

If desired, the protective elements can be designed in a signal color, such as, for instance, yellow, to enhance visibility of the riser elements, which is advantageous in particular when performing operations on the riser under water by means of unmanned vehicles such as ROVs (Remotely Operated Vehicle).

The invention claimed is:

1. A protective element for a riser segment, said protective element comprising an elongated buffer body, and several, spaced-apart feet connected with the elongated buffer body, the several, spaced-apart feet being provided with an engagement part arranged for engaging on a main pipe of a bendable riser segment, a distance between the engagement part of the several, spaced-apart feet and the elongated buffer body being such that in a mounted condition on the main pipe a part of the elongated buffer body located farthest from the main pipe is located farther from the main pipe than auxiliary pipe elements arranged on the main pipe so as to extend beyond the auxiliary pipe elements and provide damage and shock protection for the auxiliary pipe elements, the elongated buffer body being made of a plastic material, and a bending stiffness of the elongated buffer body between two adjacent feet being less than a bending stiffness of the main pipe of the bendable riser segment so that the elongated buffer body avoids hampering bending of the bendable riser segment.

2. The protective element according to claim 1, further comprising at least one recess for threading through a tensioning device.

3. The protective element according to claim 2, wherein the at least one foot is provided with the at least one recess for receiving the tensioning device to fit and hold the at least one foot on the riser segment.

4. The protective element according to claim 1, wherein the engagement part has a concave part of a radius which corresponds to an outer radius of the main pipe of the riser segment.

5. The protective element according to claim 4, wherein the concave part extends through an angle of less than 60°.

6. The protective element according to claim 1, wherein the buffer body is provided with at least one supporting part.

7. The protective element according to claim 6, wherein the supporting part is located on a side of the buffer body remote from the foot.

8. The protective element according to claim 6, wherein the supporting part is located opposite the foot.

9. The protective element according to claim 6, wherein the supporting part is beveled in a longitudinal direction of the buffer body.

10. A riser part, provided with a central main pipe, with auxiliary pipe parts arranged around the main pipe at a circumference thereof, and protective elements according to claim 1, arranged around the main pipe.

11. The riser part according to claim 10, wherein the protective elements are arranged in pairs diametrically opposite each other.

12. The riser part according to claim 10, further comprising at least one float.

* * * * *